US006688582B1

(12) United States Patent
Wacinski

(10) Patent No.: US 6,688,582 B1
(45) Date of Patent: Feb. 10, 2004

(54) FORCE BALANCING DEVICE FOR A HOIST WITH TWO TRACTION CABLES AND HOIST FITTED WITH SUCH DEVICE

(75) Inventor: Andrzej Wacinski, Massongex (CH)

(73) Assignee: Plumettaz SA, Rex (CH)

( * ) Notice: Subject to any disclaimer, the term of this patent is extended or adjusted under 35 U.S.C. 154(b) by 0 days.

(21) Appl. No.: 10/130,774

(22) PCT Filed: Oct. 27, 2000

(86) PCT No.: PCT/CH00/00576

§ 371 (c)(1),
(2), (4) Date: May 22, 2002

(87) PCT Pub. No.: WO01/38217

PCT Pub. Date: May 31, 2001

(30) Foreign Application Priority Data

Nov. 23, 1999 (CH) ..... 2139/99

(51) Int. Cl.[7] ..... B66D 1/22
(52) U.S. Cl. ..... 254/297; 254/344
(58) Field of Search ..... 254/323, 344, 254/294, 295, 297

(56) References Cited

U.S. PATENT DOCUMENTS

| | | | | |
|---|---|---|---|---|
| 1,724,713 A | | 8/1929 | Johnston | |
| 2,662,732 A | * | 12/1953 | Allenbaugh | 254/277 |
| 3,666,239 A | | 5/1972 | Koshihara | 254/175.5 |
| 3,843,097 A | * | 10/1974 | Noly | 254/297 |
| 3,936,033 A | * | 2/1976 | McElroy | 254/297 |
| 3,985,047 A | | 10/1976 | Therkelsen | 74/805 |
| 4,058,295 A | * | 11/1977 | Morfitt | 254/291 |
| 4,449,697 A | | 5/1984 | Hicks | 254/297 |
| 4,909,102 A | | 3/1990 | Haga | 475/168 |
| 5,398,637 A | * | 3/1995 | Chambers | 114/343 |
| 5,842,684 A | * | 12/1998 | Aho | 254/344 |

FOREIGN PATENT DOCUMENTS

| | | | |
|---|---|---|---|
| FR | 2183594 | 12/1973 | |
| WO | WO 88/05999 | 8/1988 | A01K/73/06 |

* cited by examiner

*Primary Examiner*—Kathy Matecki
*Assistant Examiner*—Evan Langdon
(74) *Attorney, Agent, or Firm*—Pearne & Gordon LLP

(57) ABSTRACT

The invention concerns a load balancing device consisting of a planetary or trochoidal mechanical differential speed reducer, arranged on a winch comprising two drums and enabling to balance the torque exerted on the drums. Thus, if a cable is improperly wound on one of th drums, the balancing device enables the tensile load exerted on each wire to remain identical. Such a device is particularly efficient to ensure security for a working platform operating on a building facade.

19 Claims, 4 Drawing Sheets

FORCE BALANCING DEVICE FOR A HOIST WITH TWO TRACTION CABLES AND HOIST FITTED WITH SUCH DEVICE

BACKGROUND OF THE INVENTION

The present invention concerns a balancing device for traction forces, specifically intended for a hoist, that is supposed to simultaneously wind or unwind two or more traction cables, as well as a hoist fitted with such a device and a gondola equipped with at least one hoist as hereinabove.

Such hoists, particularly those comprising a twin winding organ, traction drums or traction sheaves where each of said organs carries its own cable, find numerous applications. Particularly in certain configurations they are employed for lifts or more specifically for gondolas engaged in the cleaning and/or upkeep of the facades of high-rise buildings. Such a gondola usually is held by four cables, a first pair of cables being arranged at a first short side of the gondola and the second pair of cables being arranged at the second short side of the gondola. Each pair of cables is wound/unwound from a hoist equipped with two drums, with each hoist having its own motor that is controlled independently of the other motor. Thus, the speed of winding/unwinding of each hoist is so adjusted by known mechanical, electric, or electronic means that each pair of cables is unwound or wound with the same speed and the gondola will remain horizontal. For the two cables of a given pair, to the contrary, since their winding or unwinding speed is controlled by a single hoist or by just one motor, said means cannot be employed to preserve their balance. An unbalance between the two cables of a pair may arise, for instance, when the winding of one of the cables on its drum is irregular and causes subsequent windings to be wound with a larger diameter than that of the windings of the other cable. In this case the cable being wound up on a larger diameter will tend to assume the full traction force, which may lead to an unbalance of the gondola or, by rupture of this overly loaded cable, to risk for the workers riding this gondola.

A first mechanical means that allows an identical tensile stress to be preserved for the two cables of a given pair, even in a situation where one of the cables is poorly wound, consists of bringing the two cables together on one sheave. Such a device may be dangerous in the instance of rupture of one of the cables, since the other cable then becomes free, and the gondola is no longer held by either of the two cables.

According to other means, the two cables are attached to the two ends of a spreader while the center of this spreader is hinged to the suspension beam or to the gondola. This device will not encounter the drawback mentioned earlier, but now the difference in lengths that can be admitted between the two cables is limited by the length of the spreader.

In the two means described above, the balancing device—sheave spider or center of the spreader—is attached to the gondola or suspension beam in a single point, which in the final analysis is detrimental to the gondola's balance. FR-A-2 183 594 describes a device with differential for a crane lifting hoist. Using this device the operator controls sequentially rather than simultaneously a lifting operation and a mast telescoping operation. There is no indication anywhere in this document that the device permits a simultaneous actuation of both drums.

WO 88/05999 describes a differential device allowing the forces on two traction cables of a trawl to be balanced. This document explicitly describes that the operations of launching of the trawl as well as those of hauling it in do not involve the use of the differential device, which is put in operation, only during the fishing, that is, when the hoists are inactive.

SUMMARY OF THE INVENTION

The invention provides a force balancing device for a hoist intended for at least one pair of traction cables that will allow the drawbacks mentioned earlier to be avoided.

It is an objective of the invention to propose a hoist that is intended for at least one pair of traction cables and is fitted with at least one force balancing device that is capable of ensuring at all times the safety of the object suspended on the cables.

It is yet another objective of the invention to propose a gondola for facade upkeep that is fitted with at least one hoist equipped with a force balancing device.

These objectives are attained by a balancing device, a hoist, and a gondola having the characteristics mentioned in the independent claims, while specific embodiments or variants are described in the dependent claims.

The below description describes several embodiments of a device according to the invention, and should be read in conjunction with the attached drawing comprising the figures where

DESCRIPTION OF THE PREFERRED EMBODIMENTS

Figure 1:
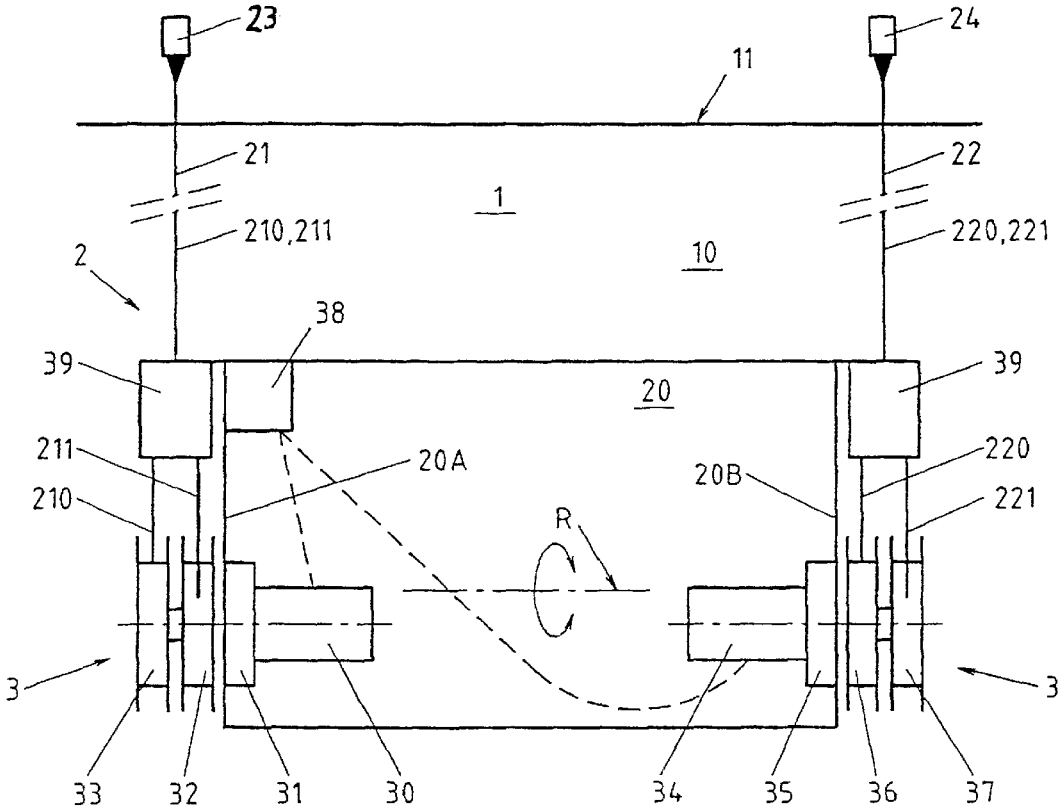
FIG. 1 is an elevation of part of an installation for facade cleaning.
Figure 2:
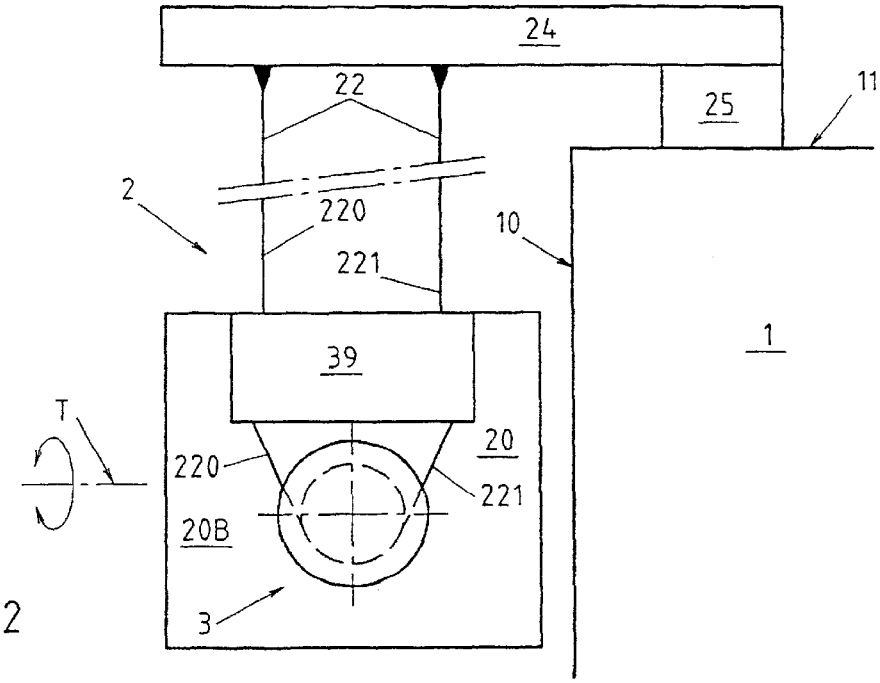
FIG. 2 is an end view of part of the installation of the preceding figure.

In FIGS. 1 and 2, one has a building 1 with a vertical facade 10 and a roof 11, here represented as being a flat roof. Building 1 is equipped with an installation 2 for cleaning/upkeep of the facade 10 comprising a gondola 20 suspended from a first pair of cables 21 and a second pair of cables 22, with two support beams 23 and 24 fixed on a frame 25 that preferably can move on the roof 11 so that the gondola 20 will be able to reach all of the facade 10.

The gondola 20 that is shown here comprises more particularly two end faces 20A and 20B each carrying a hoist 3 allowing the gondola 20 to be raised or lowered along the facade 10. The first hoist 3 comprises more particularly a first motor 30, preferably an electric motor, a first reduction gear 31, as well as two drums 32 and 33 mounted coaxially at the wall 20A, while the second hoist comprises a second motor 34, a second reduction gear 35, and two further drums 36 and 37 mounted coaxially at the wall 20B. The two drums 32 and 33 of the first hoist each take one cable 210 or 211, respectively, of the first pair of cables 21 while the two drums 36 and 37 each take one cable 220 or 221, respectively, of the second pair of cables 22. The free ends of cables 210 and 211 of the first pair 21 are attached to the beam 23, preferably detachably, while the free ends of cables 220 and 221 are attached in like manner to the beam 24.

A control unit 38 supplies and controls each of the motors 30 and 34.

Optionally and depending on the configuration that is selected for the drums, the gondola may also comprise two additional units shown schematically at 39 which are suitable for performing one of more of the following functions: changeover of the cables 210, 211 and 220, 221 distributed along an axis parallel to the axis of rotation of the drums, as shown in FIG. 1 in the space between the drums and the units 39, to a configuration where each cable pair is arranged within a plane perpendicular to the above mentioned axis, as shown in FIG. 2, or, in another embodiment of the gondola that is not represented in the figures, to a plane parallel to said axis, in the section situated between the unit 39 and the beam 24, level winding of each cable on its drum, and safety brake blocking the cable or cables when a cable rupture is detected. These different means are known in the art and will hence not be described in more detail here.

An irregular winding of one or several of the above cables on one or several of the drums mentioned may lead to an unbalance in the load distribution between the cables 210 and 211 or 220 and 221, or to an unbalance of the gondola 20 that corresponds to an angular slippage about the longitudinal axis of roll R or an angular slippage about the transverse axis of pitch T, or to a combination of these two slippages.

In the embodiment represented, slippage about the axis T when present can be compensated by acting on the relative speeds of the two motors 30 and 34, either by an organ for automatic detection of said slippage or manually via the control unit 38.

Since the two drums 32 and 33 of the first hoist or the two drums 36 and 37 of the second hoist are controlled by a single motor 30 or 34, respectively, it is not possible to compensate slippage about the axis R by the means just mentioned.

It is proposed to this effect according to the invention to instal a mechanical balancing device between the two drums, 32 and 33 or 36 and 37, respectively, of each hoist.

Figure 4:
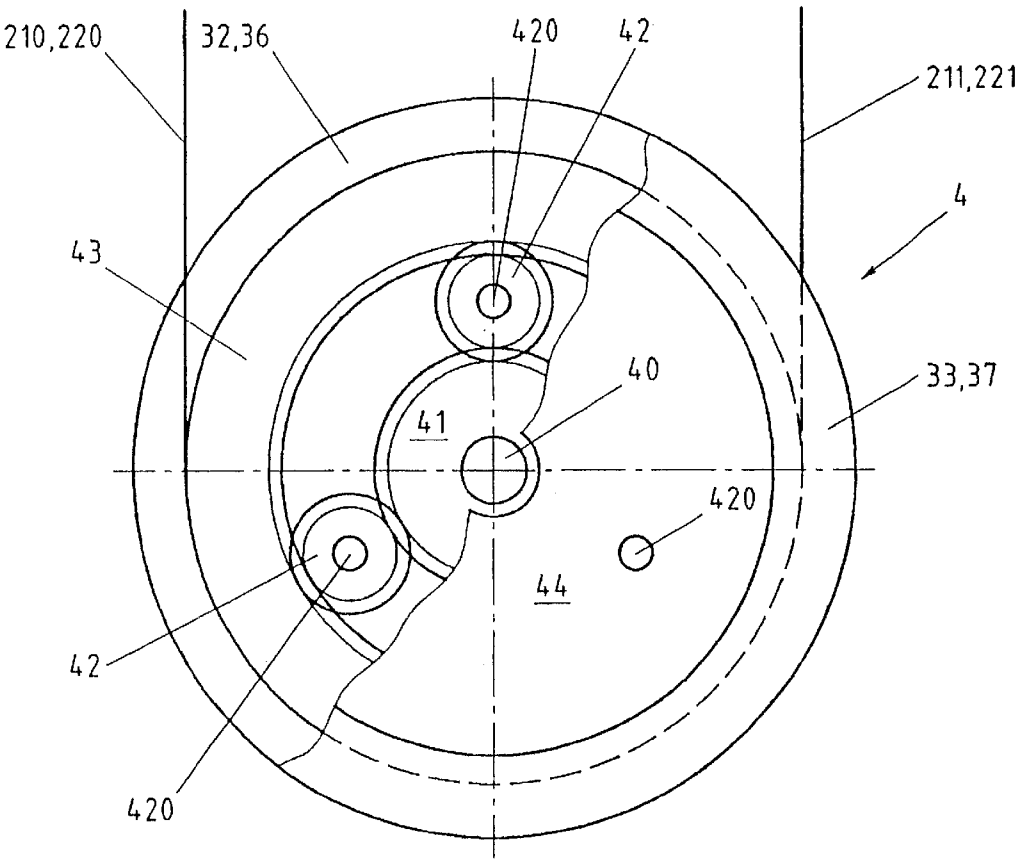
FIG. 4 is a partly sectioned front view of the device of the preceding figure.
Figure 3:
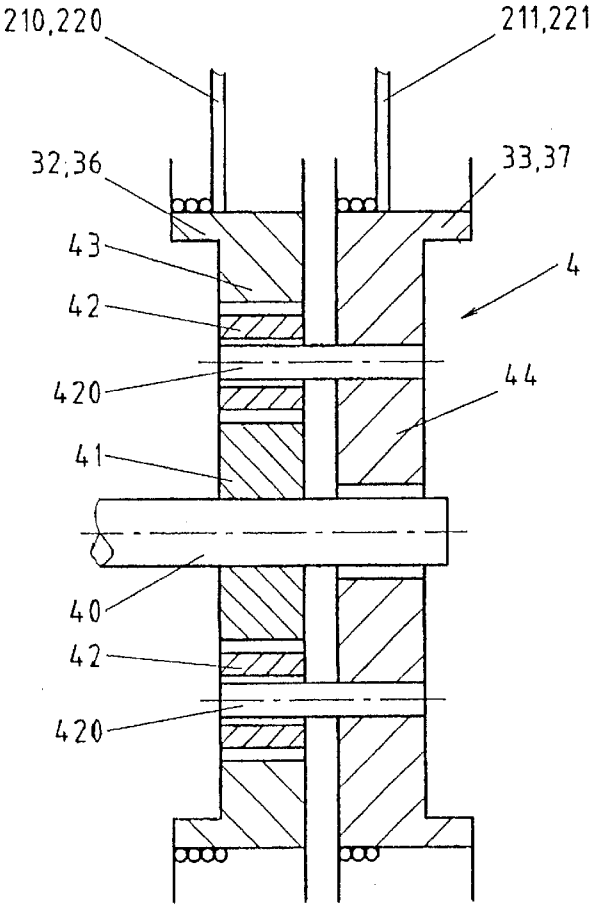
FIG. 3 is a view in longitudinal section of a first embodiment of a balancing device according to the invention.

According to a first embodiment, the balancing device consists of a mechanical differential reduction gear with three axles, as for instance the planetary gears 4 as shown in FIGS. 3 and 4. The device 4 comprises an input shaft 40 that is driven directly by the motor 30 or 34 or by the reduction gear 31 or 35, as needed. A sun gear 41 is solidly mounted on the shaft 40. One or several planet gears 42 engage, on one hand with the sun gear 41 and on the other hand with an external race 43 with internal teeth. The race 43 carries the drum 32 or 36 that is part of a lifting mechanism. Each of the planet gears 42 is pivoted on an axle 420, while said axles are fastened to a flange 44 that freely pivots about the end of shaft 40. Flange 44 carries the drum 33 or 37.

Looking at FIG. 4 and assuming that the shaft 40 or sun gear 41 turns clockwise, while blocking the drum 32 or 36 or the race 43, respectively, one can see that the flange 44 that carries the drum 33 or 37 also turns clockwise. If to the contrary one blocks the drum 33 or 37 or the flange 44, respectively, one can see that the drum 32 or 36 turns counterclockwise while the shaft 40 turns clockwise. Thus, in order to obtain a simultaneous ascending or descending motion of the gondola according to the direction of rotation of the shaft, it will be necessary that the two cables of one pair be wound up in opposite directions onto the two drums, as seen in FIG. 4.

The balancing device 4 for the traction forces functions as follows, in the situation where the two cables of one pair exert the same traction force on the two drums or identical torques are exerted, respectively, the two drums are rotated in opposite directions when the shaft 40 is rotated, and thus cause the gondola to ascend or descend, depending on the direction of rotation of shaft 40. In a situation where one of the cables is wound up with a diameter that is different from that of the other cable, which causes the force exerted on one of the cables to be more important than that exerted on the other cable, then the drum holding the more highly taut cable will block and cause the motion performed by the other drum to continue until the difference in forces is made up and the forces exerted on the two cables are once more essentially identical.

One thus has a differential balancing device between the two drums which acts so that, when one cable is more highly taut than the other, the torque created on the drum by this taut cable causes the race or flange adjacent to this drum to become a fixed point of the device, thus allowing the other element, flange or race, as well as the adjacent drum to make up this difference in tension, no matter whether the drive shaft is driven or not. Through this device the two cables of a pair of cables are thus always subject to essentially identical traction forces, even if the speeds of rotation of the two drums are not identical.

Design versions of this device that differ from the one just described can be envisaged. For instance, the size ratios of the different gear wheels that are present may be different from what has been described or represented, just like known design variations of triaxial planet reduction gears, for instance, a number of planetary gears that is different from the number shown here, or another way of meshing of the gear wheels.

Figure 6:
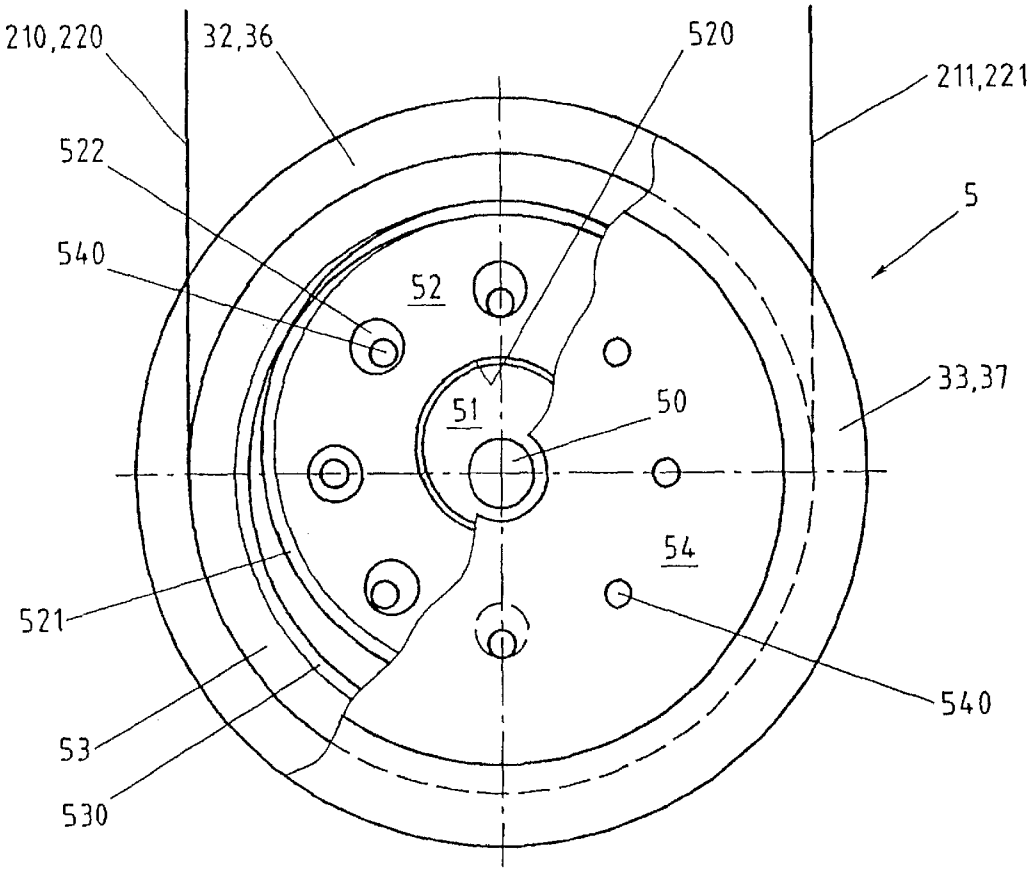
FIG. 6 is a partly sectioned front view of the device of the preceding figure.
Figure 5:
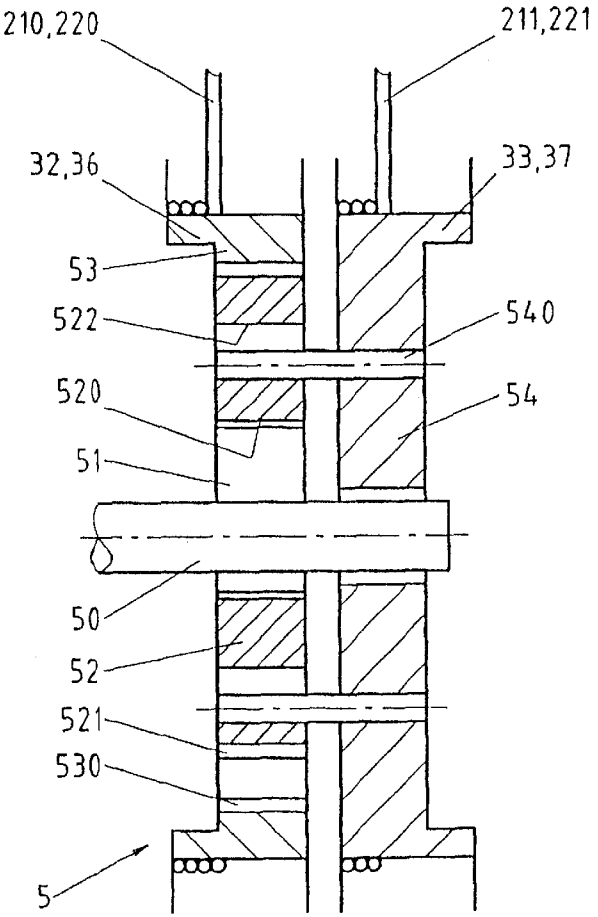
FIG. 5 is a view in longitudinal section of a second embodiment of a balancing device according to the invention.

A second embodiment of a balancing device according to the invention is represented in FIGS. 5 and 6. This device, which is again a mechanical differential reduction gear with three axles, essentially corresponds to a trochoidal (cycloidal) reduction gear such as that known by the name of "Cyclo" (registered trade mark), a specific embodiment of which is described in EP 0 291 052.

This device 5 comprises an input shaft 50 that, like the shaft 40 of the preceding device, comes directly from the drive motor or from an intermediate reduction gear. The shaft 50 comprises an eccentric cyclindrical bearing surface 51 that is fixed on the shaft. The eccentric bearing surface causes eccentric rotation of a toothed wheel 52 that has a central cylindrical bore 520, or equivalent means for rotation mounted on the eccentric bearing surface 51, external teeth 521 of which a specific embodiment will be described in greater detail below, as well as a plurality of circular bores 522 regularly spaced along a diameter that is coaxial to the central bore 520 and to the teeth 521. The device 5 additionally comprises an external race 53 with internal teeth 530 of which a specific embodiment will also be described below, and which in part engages with the teeth 521 of the wheel 52. A flange 54 is freely pivoted on the shaft 50 and supports a plurality of protruding rods 540, each of them corresponding to a bore 522 of the wheel 52. It can be seen in the figure that the bores 522 have a larger diameter than the rods 540; this device of bores and rods actually serves to transpose the eccentric rotary motion of the wheel 52 to a concentric rotary motion of the flange 54 about the shaft 50. To this effect the diameter of a bore 522 is equal to the diameter of a rod 540 plus the amount of eccentricity of the wheel 52. One may have one or more sets of bores and rods for the transmission of this motion, and it is also feasible that one or several bores are arranged on the flange 54 while the corresponding rod or rods are attached to the wheel 52. The external race carries the drum 32 or 36 which holds the cable 210 or 220, respectively, while the flange 54 carries the drum 33 or 37 which holds the cable 211 or 221, respectively.

Figure 7:
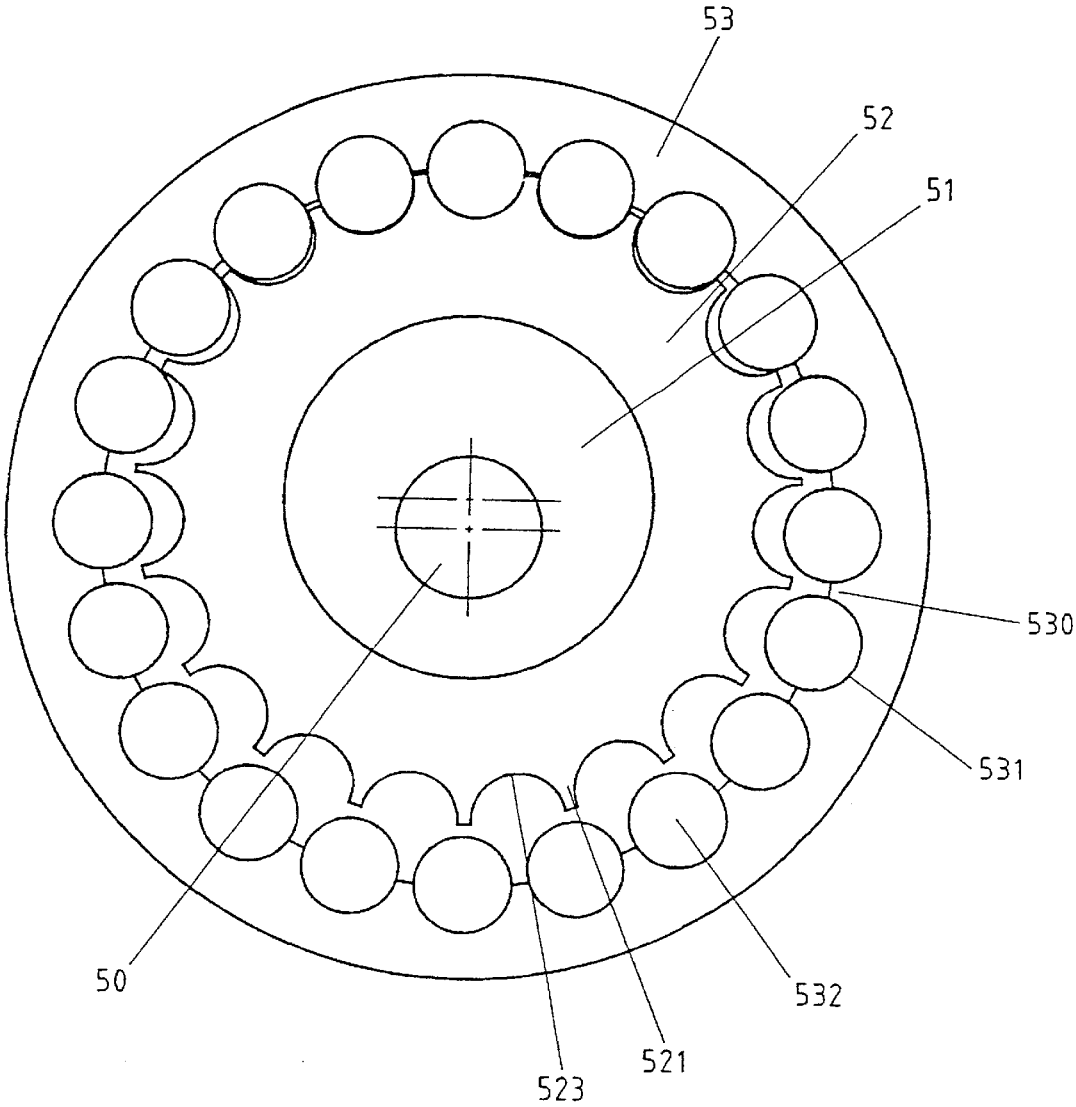
FIG. 7 is a schematic representation of the operation of part of the device of FIGS. 5 and 6.

FIG. 7 shows a preferred embodiment of part of the device just described, showing the engagement of wheel 52 in the race 53. The race 53 has a plurality of semicylindrical bearings 531 each holding a roller 532 freely turning in said bearing 531. In the example represented, the race 53 comprises twenty bearings 531 and as many rollers 532. The eccentric wheel 32 has a plurality of semicylindrical bearings 523 on its periphery, the number of said cylindrical bearings here being one less than that of the rollers 532. One will thus understand that, when the race 53 is blocked, one has one revolution of the eccentric wheel 52 for any nineteen revolutions of the shaft 50, or one revolution of the flange 54 or of the drum 33 or 37 supported by this flange, for one revolution of the shaft 50. When blocking the flange 54 or the drum 33 or 37, or the wheel 52, respectively, to the contrary, one has twenty revolutions of the race 53 or of the drum 32 or 36 supported by this race, respectively, for one revolution of the shaft 50.

It is an advantage of a differential trochoidal balancing device according to this second embodiment described, over the planetary device according to the first embodiment described, that the ratio of speeds of the drums to the speed of the drive shaft is distinctly larger, so that it becomes possible with a trochoidal balancing device according to this second embodiment to omit placing a speed reduction gear 31 or 35 between the motor and the input shaft 50 of the balancing device.

Different design variants of a differential trochoidal balancing device can be envisaged; for instance, one can have a difference between the number of rollers 532 and the number of bearings 523 on the wheel 52 that is larger than one, for instance two or three. Likewise, the external teeth 521 of the wheel 52 and the internal teeth 530 of the race 53 may differ from those described here, that is, one may have conventional teeth 521 and 530 where one or several teeth are engaged simultaneously. The differential trochoidal balancing device may also be designed like that described in the document EP 0,291,052, that is, comprising several wheels 52 in parallel, and eccentrically offset so as to distribute the forces in a softer and more regular way.

Other types of reduction gear can also be provided to function as a balancing device. For instance, a reduction gear of the registered trade mark Harmonic Drive, or more generally a differential mechanical reduction gear of the kind found in a car could very well perform the desired function of balancing the traction forces. Generally, any differential mechanical reduction gear mounted between the two drums could be used as a balancing means. Preferably, so as to have a compact device, a triaxial reduction gear will be used.

A balancing device according to one or the other of the embodiments envisaged can be made more complete by adding a disconnecting means, for instance a latch which will allow facile unwinding of the cables from their drums when the gondola is at ground, on order to attach them to the suspension beams.

A balancing device according to one or the other of the embodiments envisaged can also be employed in a hoist fitted with two traction sheaves, rather than two drums; preferably, the traction sheaves will then be fitted with known means helping to make the cable adhere to a segment of the sheave's periphery.

The gondola described above, and shown in the figures, is conceived with the four cables, each fastened at one corner of the gondola, but other configurations for attachment of the cables can also be envisaged, for instance with the four cables aligned in a plane holding the longitudinal axis of the gondola.

Also, the gondola has been described with the hoists 3 mounted on board; but one could just as well have an installation where the two hoists 3 are arranged outside of the gondola, for instance on the structure 25 supporting the beams 23 and 24 or directly on these beams. In this embodiment one could even have a single hoist driven by just one motor, with the axle of the motor holding two sets of drums and each set of drums comprising a balancing device according to one or other of the embodiments described. Thus, a single hoist or a single motor shaft may very generally comprise several pairs of drums and/or traction wheels, each pair with its own balancing device.

The balancing device according to one or other of the embodiments described, like the hoist having such a balancing device, have been described and represented as employed with a gondola for the upkeep of a facade of a building; but both the balancing device and the hoist can be employed in many other applications.

What is claimed is:

1. A balancing device for traction forces exerted by two cables on two means of winding simultaneously rotated by motorized means, comprising a differential mechanical reduction gear with a driving axle and two driven axles, said motorized means driving the driving axle and said two means of winding being connected with the two driven axles, said two means of winding turn in opposite directions to produce a common winding or unwinding motion of the two cables.

2. A balancing device as set forth in claim 1, wherein the differential mechanical reduction gear is a planetary reduction gear.

3. A balancing device as set forth in claim 1, wherein the differential mechanical reduction gear is a trochoidal reduction gear.

4. A balancing device as set forth in claim 2, including an input shaft bearing a sun gear, at least one planet gear attached to and rotating with a flange freely turning about an axle coaxial to said input shaft, an external race with internal teeth, said planet gear(s) engaging on one hand with the sun gear and on the other hand with the external race, the flange supporting one means of winding and the external race supporting the other means of winding.

5. A balancing device as set forth in claim 3, comprising an input shaft fitted with at least one eccentric cylindrical bearing surface, at least one toothed wheel comprising external teeth freely turning on said eccentric cylindrical bearing surface, as well as at least one means for transposing an eccentric circular force to a concentric circular force, an external race with internal teeth engaging with the teeth of said toothed wheel, a flange freely turning about an axle coaxial to said input shaft and rotated by said means of transposition of an eccentric circular force to a concentric circular force, the flange supporting one means of winding and the external race supporting the other means of winding.

6. A balancing device as set forth in claim 5, wherein the internal teeth of the external race consist of a first number of first semi-cylindrical bearings, each holding a roller freely turning in said first bearing, the external teeth of the wheel consisting of a second number of second cylindrical bearings engaging with the parts of the rollers not contained in said first bearings.

7. A balancing device as set forth in claim 6, wherein the first number of first bearings is higher than the second number of second bearings.

8. A balancing device as set forth in claim 7, wherein the difference between the first number of first bearings and the second number of second bearings is at least one.

9. A balancing device as set forth in claim 5, wherein said means of transposition of an eccentric circular force to a concentric circular force comprises at least one rod parallel to the input shaft and cooperating with a circular bore the internal diameter of which is equal to or greater than the external diameter of the rod plus the eccentricity of said eccentric cylindrical bearing surface.

10. A balancing device as set forth in claim 9, wherein at least one of said circular bores is arranged on the toothed wheel while at least one of said rods is fastened to said flange.

11. A balancing device as set forth in claim 9, wherein at least one of said circular bores is arranged on one of said flange and toothed wheel members while at least one of said rods is fastened to the other of said flange and toothed wheel members.

12. A balancing device as set forth in claim 1, wherein it is made more complete by adding a reduction gear acting on the input shaft.

13. A balancing device as set forth in claim 1, including a guide mechanism fit to cause the cables to change from a first arrangement where said cables are spaced along an axis parallel to the axis of rotation of the means of winding to a second position in which said cables are arranged in a plane perpendicular to said axis, and vice versa.

14. A balancing device as set forth in claim 1, including a level wind guide fit to distribute each cable side by side on its respective means of winding while said cable is wound up on said two means of winding.

15. A balancing device as set forth in claim 1, including an emergency brake mechanism fit when said mechanism detects a rupture in one cable to block the other cable.

16. A balancing device as set forth in claim 1, arranged as a hoist for the simultaneous winding or unwinding of said pair of cables.

17. A hoist as set forth in claim 16, wherein said two means of winding comprises two drums.

18. A hoist as set forth in claim 16, wherein said two means of winding comprises two traction sheaves.

19. A hoist according to claim 16, including a gondola for the upkeep of a facade.

* * * * *